US005098257A

United States Patent [19]

Hultgren et al.

[11] Patent Number: 5,098,257

[45] Date of Patent: Mar. 24, 1992

[54] APPARATUS AND METHOD FOR MINIMIZING DIFFERENTIAL THERMAL EXPANSION OF GAS TURBINE VANE STRUCTURES

[75] Inventors: Kent G. Hultgren, Winter Park; John C. Matarazzo, Orlando, both of Fla.

[73] Assignee: Westinghouse Electric Corp., Pittsburgh, Pa.

[21] Appl. No.: 580,060

[22] Filed: Sep. 10, 1990

[51] Int. Cl.[5] ..... F01D 5/08

[52] U.S. Cl. ..... 415/115; 415/116; 415/178; 60/39.75

[58] Field of Search ..... 415/115, 116, 177, 178; 416/96 R, 97 R; 60/39.75

[56] References Cited

U.S. PATENT DOCUMENTS

| | | | |
|---|---|---|---|
| 3,628,880 | 12/1971 | Smuland | 415/115 |
| 3,902,819 | 9/1975 | Holchendler et al. | 416/97 R |
| 3,975,901 | 8/1976 | Hallinger et al. | 415/115 |
| 4,117,669 | 10/1978 | Heller | 415/115 |
| 4,318,666 | 3/1982 | Pask | 415/116 |
| 4,353,679 | 10/1982 | Hauser | 415/115 |
| 4,573,865 | 3/1986 | Hsia et al. | 416/97 R |
| 4,574,451 | 3/1986 | Smashey et al. | 416/97 R |
| 4,826,397 | 5/1989 | Shook et al. | 415/178 |
| 4,902,198 | 2/1990 | North | 415/115 |
| 4,962,640 | 10/1990 | Tobery | 415/115 |

FOREIGN PATENT DOCUMENTS

| | | | |
|---|---|---|---|
| 1175816 | 12/1969 | United Kingdom | 415/115 |
| 2162587 | 2/1986 | United Kingdom | 415/115 |

OTHER PUBLICATIONS

A. J. Scalzo et al., "A New 150MW High Efficiency Heavy-Duty Combustion turbine", America Society of Mechanical Engineers paper, 88-GT-162, 1988.

*Primary Examiner*—Edward K. Look
*Assistant Examiner*—Christopher M. Verdier

[57] ABSTRACT

An apparatus and method are provided for minimizing differential thermal expansion in external cooling air structures formed on the shrouds of the vane segments of a gas turbine. The external cooling air structure is formed from a laminate comprised of two layers joined in sandwich-like fashion. A passageway, which may be of a serpentine arrangement, is formed between the two layers of the laminate. Hot gas flowing over the shroud is directed through the passageway, thereby heating the structure so that its temperature is close to that of the shroud. Cooling air is bled into the hot gas directed to the passageway so as to reduce the temperature of the hot gas flowing through the passageway and prevent overheating of the external cooling air structure.

25 Claims, 5 Drawing Sheets

APPARATUS AND METHOD FOR MINIMIZING DIFFERENTIAL THERMAL EXPANSION OF GAS TURBINE VANE STRUCTURES

FIELD OF THE INVENTION

The present invention relates to gas turbines. More specifically, the present invention relates to an apparatus and method for minimizing differential thermal expansion in gas turbine vane segments, especially differential thermal expansion in external structures which form cooling air passageways on the vane segments.

A portion of the annular gas flow path in the turbine section of a gas section is formed by a plurality of vane segments circumferentially arrayed around the rotor. Each vane segment is comprised of an inner and an outer shroud, which together form the boundaries of the gas flow path, and one or more vanes.

In order to insure that the material forming the vane segments is not overheated, thereby compromising its strength, the vane segments of modern gas turbines are cooled with air bled from the compressor section. This cooling air is often supplied to both the inner and outer shrouds, from which it is distributed throughout the vane segments. In order to effectively utilize this cooling air, external structures are formed on the vane segment shrouds to contain and distribute the cooling air. Typically, these structures are attached to the surfaces of the shrouds opposite the surfaces exposed to the hot gas flowing through the turbine section. The present invention concerns an improved type of such external structure.

BACKGROUND OF THE INVENTION

As previously discussed, structures which contain and distribute cooling air to the vane segment shrouds are typically affixed to the surface of the shrouds opposite those surfaces exposed to the hot gas flowing through the turbine section. These structures are referred to as "external" cooling air structures to distinguish them from structures for distributing cooling air which are formed inside the airfoil portions of the vane segments. During operation, the shrouds get very hot as a result of the flow of the hot gas over them. The structures, however, have cooling air flowing over them and hence do not get nearly as hot as the shrouds. As a result, severe thermal stresses are induced in the structures due to the differential thermal expansion between the shroud and the structure.

According to the prior art, the thermal stresses were reduced by forming the structures from thin plates, thereby making them as flexible as possible. However, a minimum amount of strength and stiffness is necessary to ensure that the structures can withstand the pressure of the cooling air inside them. As a result of this trade off between strength and flexibility, the prior art approach has yielded less than optimum results.

Accordingly, it would be desirable to provide an apparatus and method for minimizing the differential thermal expansion between the shrouds and the external cooling air structures attached to them.

In the past, certain components exposed to hot gas flow in the combustion section of a gas turbine, such as combustors or transition ducts, have been formed from laminates. The laminates themselves are formed by joining two thin plates in a sandwich-like fashion. Typically, one or more internal passageways, in a straight through or serpentine arrangement, are formed between the layers of the laminate. Cooling air flows through these internal passageways and cools the component. According to the present invention, novel use is made of such laminates by forming vane segment external cooling air structures from them. Rather than using the internal passageways for cooling purposes, hot gas flowing over the shrouds is directed through the internal passageways. The flow of hot gas heats the structures, thereby minimizing the differential thermal expansion between them and the shrouds to which they are attached.

SUMMARY OF THE INVENTION

The object of the current invention is to provide an apparatus and method for minimizing the differential thermal expansion between vane segment external cooling air structures and the shrouds to which they are attached in the turbine section of a gas turbine.

It is a further object of the invention to minimize such thermal stresses by purposefully heating the external cooling air structures by flowing hot gas through them.

It is still another object of the invention to modulate the temperature of the hot gas flowing through the structures in order to avoid over-heating them.

These and other objects are accomplished in the turbine section of a gas turbine having a plurality of stationary vane segments arranged in a circumferential array around a centrally disposed rotor. Each of the vane segments has inner and outer shrouds. A structure, which forms a passageway for cooling air, is affixed to each inner shroud. The structure is formed from a laminate of two layers. A hot gas passageway is formed between the layers. Hot gas from the combustion section flowing over the inner shroud is directed through the hot gas passageway, so as to heat the structure, thereby minimizing the differential thermal expansion between the structure and the inner shroud to which it is attached. A hole in the inner shroud bleeds cooling air into the hot gas upstream of the inlet to the hot gas passageway, so as to reduce the temperature of the hot gas entering the passageway, thereby assuring the structure is not overheated.

DESCRIPTION OF THE PREFERRED EMBODIMENTS

Figure 1:
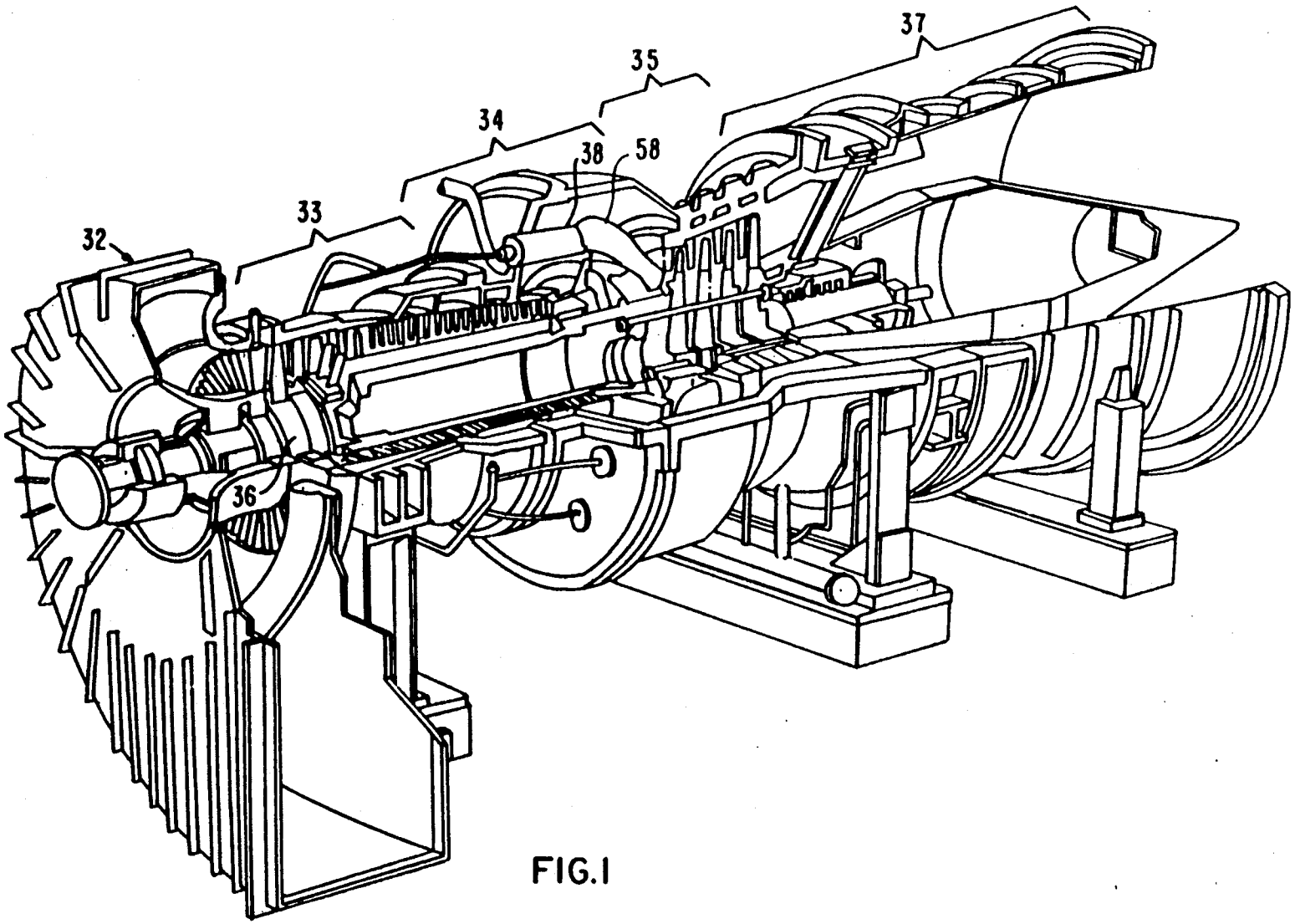
FIG. 1 is an isometric view, partially cut away, of a gas turbine.

There is shown in FIG. 1 a gas turbine. The major components of the gas turbine are the inlet section 32, through which air enters the gas turbine; a compressor section 33, in which the entering air is compressed; a combustion section 34 in which the compressed air from the compressor section is heated by burning fuel in combustors 38, thereby producing a hot compressed gas; a turbine section 35, in which the hot compressed gas from the combustion section is expanded, thereby producing shaft power; and an exhaust section 37, through which the expanded gas is expelled to atmosphere. A centrally disposed rotor 36 extends through the gas turbine.

Figure 2:
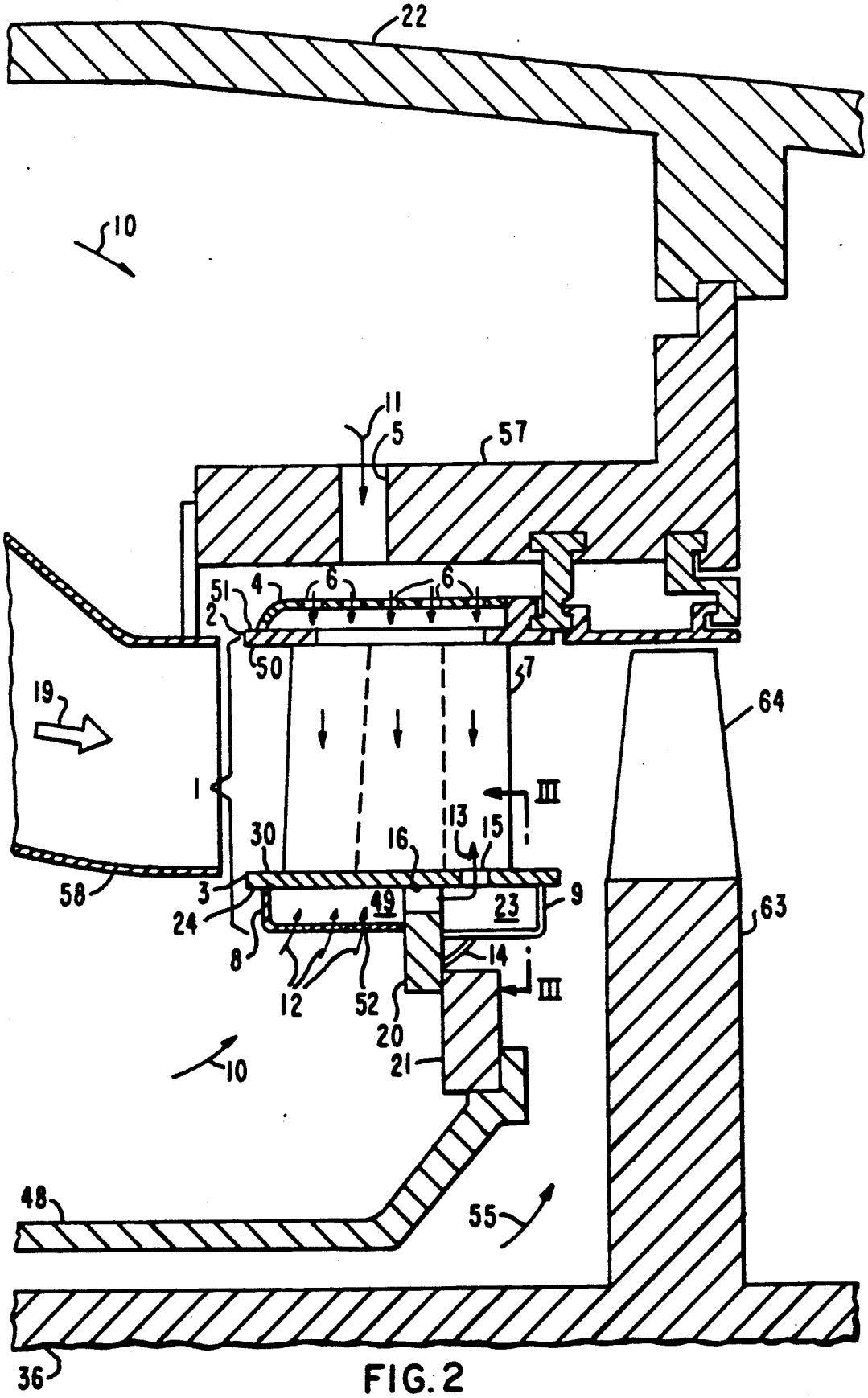
FIG. 2 is a cross-section of a portion of the turbine section of the gas turbine in the vicinity of the row 1 vanes.

The turbine section 35 of the gas turbine is comprised of alternating rows of stationary vanes and rotating blades. Each row of vanes is arranged in a circumferential array around the rotor 36. FIG. 2 shows a portion of the turbine section in the vicinity of the row 1 vane assembly. Typically, the vane assembly is comprised of a number of vane segments 1. Each vane segment 1 is comprised of a vane airfoil 7 having an inner shroud 3 formed on its inboard end and an outer shroud 2 formed on its outboard end. Alternatively, each vane segment may be formed by two or more vane air foils having common inner and outer shrouds.

As shown in FIG. 2, the vane segments 1 are encased by a cylinder 57, referred to as a blade ring. Also, the vane segments encircle an inner cylinder structure 48. The inner cylinder structure comprises a ring 21 affixed to a rear flange of the inner cylinder. A row of rotating blades 64, affixed to a disk portion 63 of the rotor 36, is disposed downstream of the stationary vanes. A turbine outer cylinder 22 encloses the turbine section.

During operation, hot gas 19 from the combustion section 34 is directed to flow over the vane segments 1 by duct 58. The flow of hot gas 19 is contained between the outboard surface 30 of the inner shroud 3 and the inboard surface 50 of the outer shroud 2.

Cooling air 10 is bled from the compressor section, thus bypassing the combustors 38, and is supplied to the inner and outer shrouds.

A portion 11 of the cooling air 10 flows through hole 5 in the blade ring 57, from whence it enters the vane segment 1 through hole 6 formed in an external cooling air structure 4, referred to as an outer shroud impingement plate. The outer shroud impingement plate 4 is affixed to the outboard surface 51 of the outer shroud 2. From the impingement plate 4, the cooling air 11 flows through the vane air foil 7 and discharges into the hot gas 19 through holes (not shown) in the walls of the airfoil portion of the vane segment.

Figure 3:
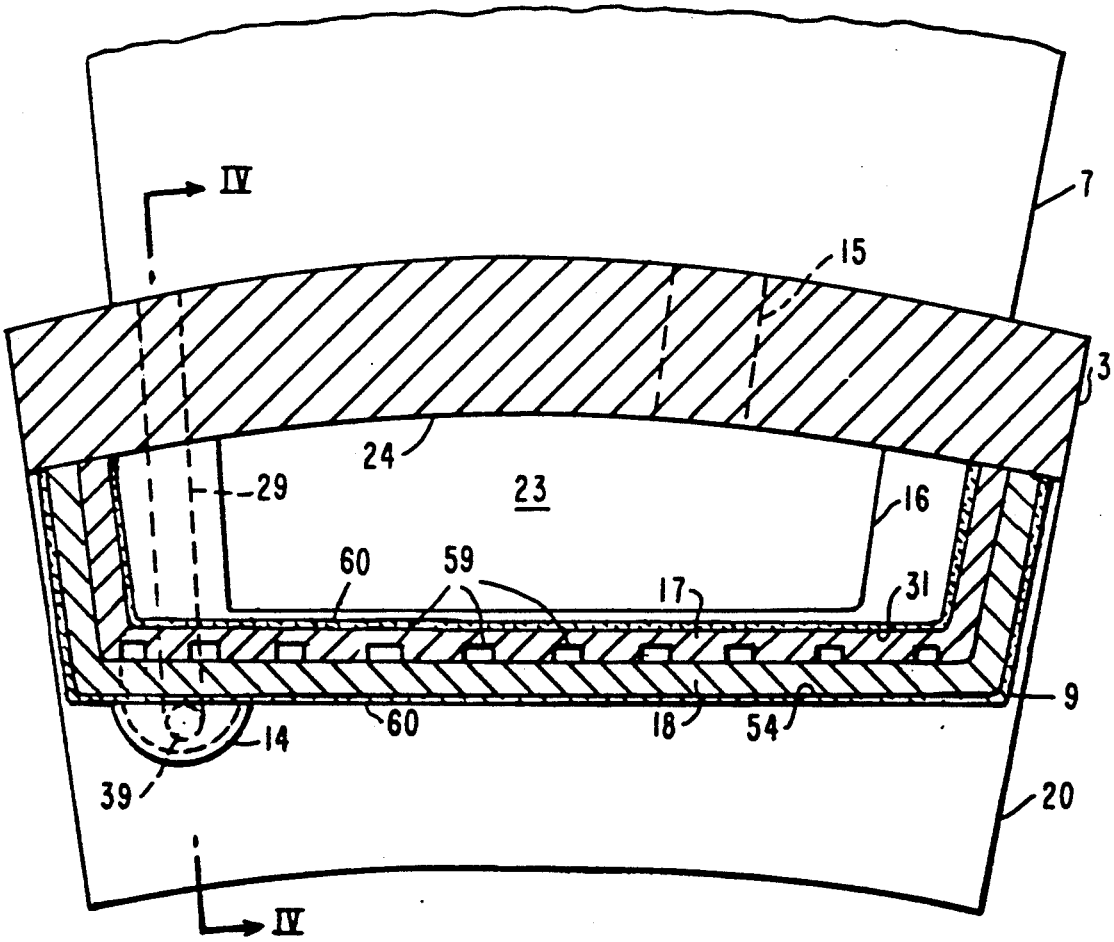
FIG. 3 is a cross-section taken through line III—III, shown in FIG. 2, showing the containment cap formed on the inner shroud.

A portion 12 of the cooling air 10 flows through holes 52 formed in a second external cooling air structure 8, referred to as an inner shroud impingement plate. The inner shroud impingement plate 8 is affixed to the inboard surface 24 of the inner shroud 3. A lug 20 emanates radially inward from the inboard surface 24 of the inner shroud 3, and serves to prevent leakage of cooling air 10 to the turbine section by bearing against the ring 21. The inner shroud impingement plate 8 forms a passageway 49 through which the cooling air 12 flows. From passageway 49, the cooling air flows through opening 16 in the lug 20 and enters a third external cooling air structure 9, referred to as a containment cap. The containment cap 9 is affixed to the inboard surface 24 of the inner shroud 3. As shown in FIG. 3, the inner surface 31 of the containment cap 9 and the inboard surface 24 of the inner shroud form a passageway 23 through which cooling air 13 flows. From passageway 23, the cooling air 13 flows into the airfoil portion of the vane through a hole 15 in the inner shroud and eventually discharges into the hot gas 19 through holes, not shown, in the walls of the airfoil and through passageways, not shown, in the trailing edge of the airfoil.

Cooling air 55, which is also bled from the compressor section, flows through the rotor 36. This cooling air flows over the upstream face of the disk 63 and over the containment cap 9 before discharging into the hot gas 19 flowing over the inner shroud.

As previously discussed, hot gas 19 from the combustion system flows over the outboard surface 30 of the inner shroud 3 and the inboard surface 50 of the outer shroud 2. The temperature of the hot gas flowing over the shrouds is typically approximately 900° C. (1650° F.). On the surfaces 24 and 51, opposite the surfaces exposed to the hot gas, the shrouds are exposed to the cooling air 6, 12, 13, which is typically at a temperature of approximately 400° C. (750° F.). As a result, the average temperature of the shrouds themselves is approximately 700° C. (1300° F.).

In contrast to the shrouds, the surfaces of the external cooling air structures, such as surfaces 31 and 54 of the containment cover 9, are exposed to cooling air on both their inboard and outboard surfaces. Thus, in the absence of any purposeful heat up, the temperature of the structures is approximately the temperature of the cooling air, i.e. 400° C. (750° F.). As a result of the large temperature difference between the shrouds and the external cooling air structures, there is considerable differential thermal expansion between the two components, giving rise to large thermal stresses. The present invention concerns an apparatus and method for minimizing the differential thermal expansion between the containment cap 9 and the inner shroud 3 by purposeful heating of the containment cap.

Figure 4:
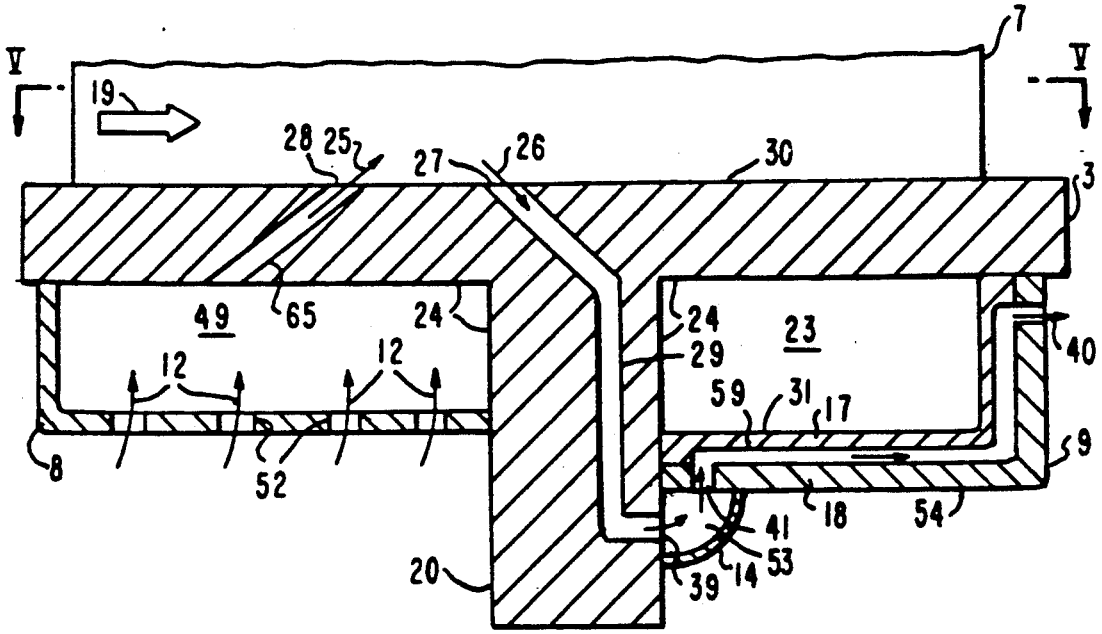
FIG. 4 is a cross-section taken through line IV—IV, shown in FIG. 3.
Figure 6A:
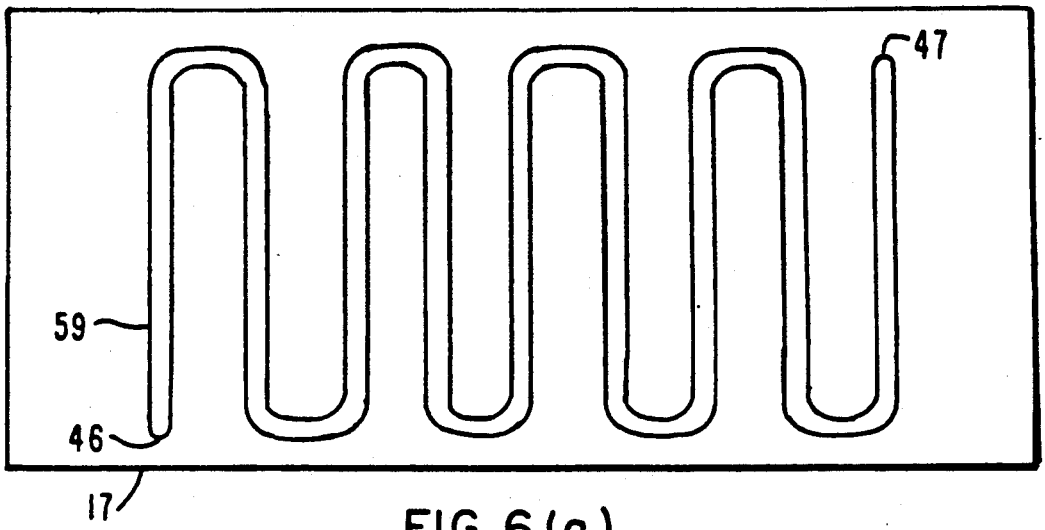
FIG. 6 is a plan view of one of the plates forming a laminate from which the containment cap is formed. Two embodiments of the gas flow path arrangement are shown, a serpentine arrangement (a) and a straight-through arrangement (b).
Figure 6B:
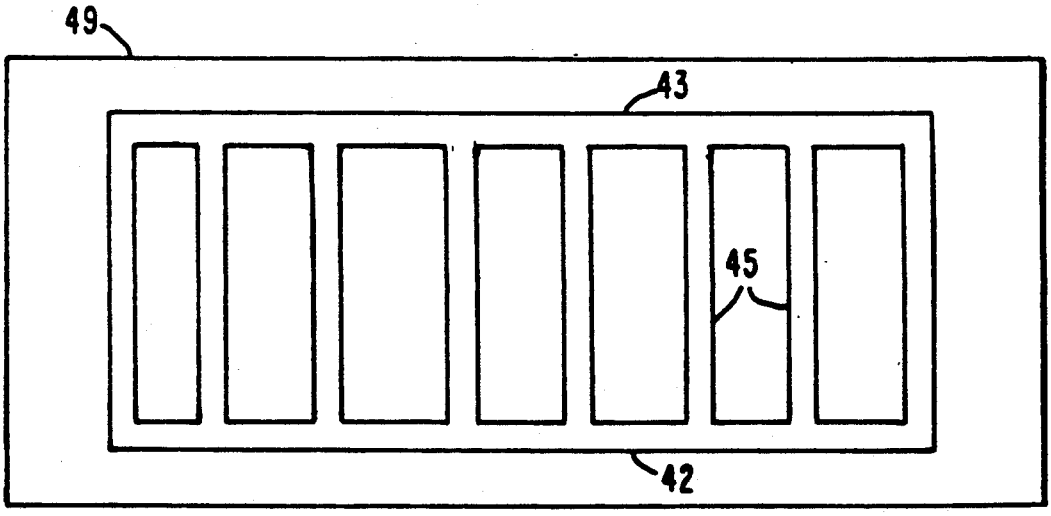

As shown in FIGS. 3 and 4, according to the present invention, a passageway 59 is formed between the inner surface 31 and the outer surface 54 of the containment cap 9. In the preferred embodiment, the passageway 59 is created by forming the containment cap 9 from a laminate comprised of two layers 17, 18 of thin plates, having contiguous surfaces along which they are joined in a sandwich-like fashion by brazing or diffusion bonding. In the preferred embodiment, each layer 17, 18 is approximately 0.076 cm (0.030 inch) thick. The passageway 59 is formed between the two layers 17, 18. Layer 17 of the laminate is shown in FIG. 6 prior to being shaped into the containment cap 9. In the preferred embodiment, the passageway 59 is comprised of a groove machined into, and extending parallel to, the surface along which layer 17 is joined to layer 18. The passageway 59 is formed in a serpentine arrangement, as shown in FIG. 6(*a*), having two ends 46 and 47. As a result of the multiple passes associated with the serpentine arrangement, even heating is obtained throughout the containment cap 9. Alternatively, two or more serpentine passageways could be formed side by side in the plate, each having its own ends. Moreover, a laminate layer 49 having a straight-through flow path, such as that shown in FIG. 6(*b*), could be utilized. In this case, passageways 42 and 43 form inlet and outlet manifolds, respectively. A series of parallel flow paths 45 connect the inlet and outlet manifolds.

As shown in the preferred embodiment, passageway 59 is formed by grooves in only the outboard layer 17 of the laminate. However, the passageway could also formed by grooves in the inboard layer 18 or mating grooves in both layers. In the preferred embodiment, the depth of the groove is approximately one-half the thickness of the layer 17 and the pitch of the grooves is approximately twice their width, thereby ensuring adequate and even heating of the entire surface of the containment cap.

As shown in FIG. 4, a passageway 29 is formed in the inner shroud. The inlet 27 to the passageway is disposed on the outboard surface 30 of the inner shroud and the outlet 39 is disposed on the downstream face of the lug portion 20 of the inner shroud. A portion 26 of the hot gas 19 flowing over the outboard surface 30 of the inner shroud enters inlet 27, flows through passageway 29 and discharges at outlet 39. From the outlet 39, the hot gas 26 flows into a cavity 53, formed by a plate 14 affixed to the outer surface 54 of the containment cap 9 and the lug 20. From cavity 53, the hot gas flows through an opening 41 in layer 18 of the laminate. The opening 41 is aligned with the end 46 of the serpentine, shown in FIG. 6(*a*), so that opening 4 forms the inlet to the passageway 59. A second opening 40 is formed in layer 18 and is aligned with end 47 of the serpentine, thus forming the outlet of the passageway 59. The hot gas 26 flows through the passageway and discharges through opening 40 into the hot gas 19 flowing downstream of the inner shroud. In the alternative arrangement shown in FIG. 6(*b*), the inlet 41 and outlet 40 are connected to the inlet manifold 42 and outlet manifold 43, respectively.

Figure 5:
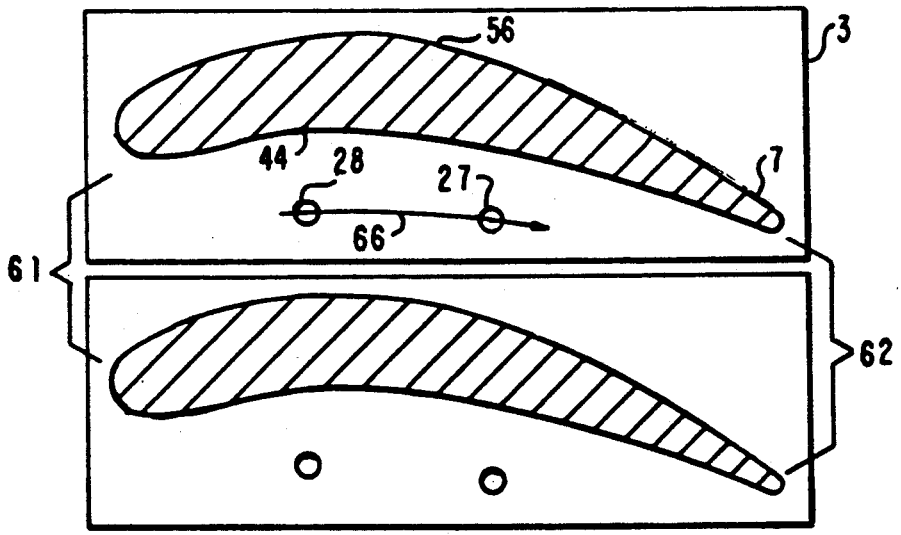
FIG. 5 is a cross-section taken through line V—V, shown in FIG. 4, showing two adjacent vane segments.

The pressure of the hot gas 19 decreases as it flows through the turbine section as a result of the expansion it undergoes therein. As can be seen in FIG. 5, the flow area at the outlets 62 to the vane segments is greater than the flow area at their inlets 61. Thus, the pressure of the hot gas flowing over the upstream portion of the inner shroud — that is, the portion nearer the vane segment inlet 61 — is greater than the hot gas flowing over the downstream portion of the shroud — that is, the portion nearer the vane segment outlet 62. Since opening 27 to passageway 29 is formed in the upstream portion of the inner shroud and outlet 40 discharges into the hot gas 19 flowing over the downstream portion of the shroud, a pressure differential exists which induces the flow of the hot gas 26 through passageways 29 and 59. Moreover, as shown in FIG. 4, the initial portion of passageway 29 is inclined at an angle toward the upstream axial direction so as to better receive the flow of hot gas.

Since, as previously discussed, the temperature of the hot gas 19 flowing over the outboard surface 30 of the inner shroud is approximately 900° C. (1650° F.) range, whereas the temperature of the inner shroud is only 700° C. (1300° F.), there is a danger that the flow of hot gas 26 through the laminate will raise the temperature of the containment cap excessively. Excessive heating of the containment cap would weaken the laminate, thereby reducing its ability to withstand the pressure associated with the cooling air 13 flowing within the containment cap. In addition, excessive heating may create additional thermal stresses in the opposite direction — that is, the containment cap would attempt to expand more than the inner shroud. Thus, in the preferred embodiment, the temperature of the hot gas 26 flowing into passageway 29 is modulated. Modulation is accomplished by a hole 65 formed in the inner shroud upstream of the inlet 27 to passageway 29, as shown in FIG. 4. Hole 65 extends from the inboard to the outboard surface of the inner shroud and directs a portion 25 of the cooling air 12 flowing through passageway 49 into the hot gas 19 flowing over the inner shroud so that the temperature of the hot gas 26 flowing into passageway 29 is reduced. By properly sizing the hole 65, the temperature of the gas 26 flowing through the laminate can be modulated so as to ensure that the containment cap 9 operates in the appropriate temperature range necessary to maintain adequate strength and minimize differential thermal expansion.

As shown in FIG. 5, the airfoil portion 7 of the vane segment has convex 56 and concave 44 surfaces. As a result of their shape, these surfaces direct the flow of the hot gas 19 through the vane segments along direction 66. In the preferred embodiment, the outlet 28 to hole 65 is aligned upstream from inlet 27 to passageway 29 along direction 31, thereby ensuring adequate mixing between the cooling air 12 and the hot gas 19 before the hot gas 26 enters the inlet 27.

Lastly, in the preferred embodiment, a thermal barrier coating 60, such as a ceramic type well known to those in the art, is applied to the inner surface 31 and outer surface 54 of the containment cap 9, as shown in FIG. 3. The thermal barrier coating retards the conduction of heat from the layers 17, 18 to the cooling air 13, 55, thereby avoiding the unnecessary heat-up of the cooling air 13 and ensuring that the hot gas 26 flowing through passageway 59 adequately heats the containment cap.

Although the above description has been directed to a containment cap on the inner shroud of a vane segment, the principles disclosed herein are equally applicable to other structures formed on gas turbine members which are susceptible to excessive differential thermal expansion as a result of their being cooler than the members to which they are attached. Moreover, it is understood that although the above description has been directed to a preferred embodiment of the invention, other modifications and variations known to those skilled in the art may be made without departing from the spirit and scope of the invention as set forth in the appended claims.

Thus, the invention is applicable to any conduit, or channel, for directing the flow of a fluid, whether in a turbine environment or otherwise, wherein a cooling medium such as air passes through the conduit and the outside of the conduit is heated to a higher temperature. In such a situation, the invention embraces a passageway through at least a part of a wall forming the conduit, and means for controllably passing some of the heating medium, such as hot gas that is outside of the conduit or channel, through said passageway, thereby diminishing or modulating the temperature differentials around the conduit.

We claim:

1. A gas turbine comprising:

(a) a combustion section having means for producing a hot gas;

(b) a turbine section having a plurality of shrouds disposed therein, each of said shrouds having first and second surfaces, said turbine section having means for directing sad hot gas to flow over each of said first surfaces; and (c) a laminate structure affixed to said second surface of each of said shrouds, each of said laminate structures having first and second layers, each of said first and second layers having first and second surfaces, said first and second layers joined together along their respective first surfaces, a first passageway formed in said first surface of said first layer, each of said first passageways having an inlet and an outlet, each of said inlets and outlets in flow communication with said hot gas flowing over said first surfaces of said shrouds.

2. The gas turbine according to claim 1 further comprising a supply of cooling air and wherein said second surface of said first layer is disposed opposite said first surface of said first layer and forms a second passageway through which said cooling air flows.

3. The gas turbine according to claim 2 further comprising means for inducing a portion of said hot gas flowing over said first surfaces of each of said shrouds to flow through each of said first passageways.

4. The gas turbine according to claim 3 wherein said flow inducing means comprises a pressure differential in said hot gas flowing over said first surfaces of said shrouds between each of said inlets and each of said outlets.

5. The gas turbine according to claim 3 further comprising a plurality of vane segments arranged in a circumferential array in said turbine section, each of said vane segments having first and second ends, one of said shrouds being formed on said first end of each of said vane segments, each of said vane segments having an inlet and an outlet, each of said vane segment inlets and outlets having a flow area, said flow area of each of said vane segment outlets being greater than said flow area of each of said vane segment inlets, whereby the pressure of said hot gas is greater at said vane segment inlets than at said vane segment outlets.

6. The gas turbine according to claim 5 wherein:

a) each of said shrouds has an upstream portion and a downstream portion; and b) said flow inducing means comprises each of said inlets in flow communication with said hot gas flowing over said upstream portion of each of said shrouds, and each of said outlets in flow communication with said hot gas flowing over said downstream portion of each of said shrouds.

7. The gas turbine according to claim 5 further comprising means for reducing the temperature of said hot gas induced to flow through said first passageway.

8. The gas turbine according to claim 7 further comprising a third passageway formed in each of said shrouds, each of said third passageways placing said hot gas flowing over said upstream portions of said shrouds in flow communication with each of said inlets to said first passageways.

9. The gas turbine according to claim 8 wherein each of said third passageways has an outlet and an inlet, said inlets to said third passageways formed on said first surfaces of said shrouds, and wherein said temperature reducing means comprises:

a) means for directing cooling air from said supply to said second surfaces of each of said shrouds; and b) a fourth passageway for each of said third passageways, each of said fourth passageways formed in each of said shrouds, each of said fourth passageways having an inlet and an outlet, each of said outlets to said fourth passageways is disposed upstream of each of said inlets to said third passageways.

10. The gas turbine according to claim 9 wherein each of said vane segments has an airfoil portion, each of said airfoil portions has a first and second surface, said first and second surfaces of said airfoil formed so as to direct the flow of said hot gas flowing over said first surfaces of said shrouds along a first direction, each of said outlets to said fourth passageways aligned upstream of each of said inlets to said third passageways along said first direction.

11. A gas turbine comprising:

(a) a combustion section having means for producing a hot gas;

(b) a turbine section having a plurality of shrouds disposed therein, each of said shrouds having first and second surfaces, said turbine section having means for directing said hot gas to flow over each of said first surfaces;

(c) a supply of cooling air;

d) a structure affixed to said second surface of each of said shrouds, each of said structures having first and second layers, each of said first and second layers having first and second surfaces, said first and second layers joined along their respective first surfaces, a first passageway formed between each of said first and second layers, each of said first passageways having a serpentine arrangement and an inlet and an outlet, each of said inlets and outlets in flow communication with said hot gas flowing over said first surfaces of said shrouds, said second surface of said first layer forming a second passageway through which said cooling air flows; and e) means for inducing a portion of said hot gas flowing over said first surfaces of each of said shrouds to flow through each of said first passageways.

12. The gas turbine according to claim 3 wherein each of said first passageways comprises:

a) a first manifold, said first manifold in flow communication with said inlet to said first passageway;

b) a second manifold, said second manifold in flow communication with said outlet to said first passageway; and c) a plurality of flow paths connecting said first manifold to said second manifold.

13. The gas turbine according to claim 1 wherein said first and second layers are of approximately equal thickness, said first passageway formed by a groove in said first layer, the depth of said groove being approximately one-half the thickness of said first layer.

14. In a gas turbine through which a hot gas flows, said gas turbine having a member, said member having first and second surfaces, means for directing said hot gas flow over said first surface of said member, and a cooling air supply, an apparatus for containing and distributing cooling air from said supply comprising:

(a) a laminate structure affixed to said second surface of said member, said laminate structure having first and second layers, said first and second layers each having first and second surfaces, said first and second layers bonded together along their respective first surfaces, whereby said first surfaces of said first and second layers are contiguous;

(b) a hot gas flow path, said hot gas flow path disposed in said first surface of said first layer, said hot gas flow path having an inlet; and (c) means for directing a first portion of said hot gas flowing over said first surface of said member to said inlet of said hot gas flow path.

15. The apparatus according to claim 14 wherein said hot gas flow path has an outlet, said outlet in flow communication with said hot gas flowing over said first surface of said member.

16. The apparatus according to claim 14 further comprising means for modulating the temperature of said first portion of said hot gas directed to said inlet of said hot gas flow path.

17. The apparatus according to claim 16 wherein said temperature modulating means comprises means for directing a first portion of said cooling air from said supply into said first portion of said hot gas directed to said inlet of said hot gas flow path.

18. The apparatus according to claim 14 wherein said means for directing said first portion of said hot gas to said inlet comprises a second passageway, said second passageway extending between said first and second surfaces of said member.

19. The apparatus according to claim 18 wherein said means for directing said first portion of said hot gas to said inlet further comprises a plate affixed to said second surface of said member and said second surface of one of said layers.

20. The apparatus according to claim 19 further comprising a thermal barrier coating, said thermal barrier coating formed on said second surfaces of said first and second layers.

21. In a gas turbine through which a hot gas flows, having a vane segment, said vane segment having a shroud, said shroud having first and second surfaces, said hot gas flowing over said first surface, cooling air being supplied to said shroud, said vane segment having a laminate structure affixed to said second surface of said shroud, said laminate structure forming a first passageway for said cooling air on said second surface of said shroud, a second passageway formed in said laminate structure, a method of reducing thermal expansion between said structure and said shroud comprising the steps of:

a) directing a first portion of said hot gas flowing over said first surface of said shroud to said second passageway;

b) flowing said first portion of said hot gas through said second passageway;

c) returning said hot gas flowing through said second passageway to said hot gas flowing over said first surface of said shroud.

22. The method according to claim 21 further comprising the step of directing a portion of said cooling air supplied to said shroud to said first portion of hot gas directed to said second passageway.

23. A conduit for directing the flow of a fluid comprising a first element having first and second surfaces, a second element connected to said first element and enclosing said first surface, thereby forming a first passageway, cooling means for providing a cooling medium to said first passageway, thereby maintaining said second element at a first temperature, and heating means for providing a heating medium to said second surface of said first element, thereby maintaining said first element at a second temperature, further characterized by said second element being a laminate formed from first and second layers having first and second surfaces, respectively, along which said layers are jointed, said second element having a second passageway formed in said first surface of said first layer, and means for controllably passing a portion of said heating medium through said second passageway, thereby modulating the difference between said first and second temperatures.

24. The gas turbine according to claim 1 wherein said first passageway extends substantially parallel to said first surface of said first layer.

25. The gas turbine according to claim 3 wherein each of said passageways is comprised of an inlet and an outlet manifold and a plurality of third passageways extending therebetween.

* * * * *